US006021530A

United States Patent [19]

Davis

[11] Patent Number: 6,021,530

[45] Date of Patent: Feb. 8, 2000

[54] FEMALE URINAL BOTTLE

[76] Inventor: Daniel E. Davis, 119 Wrenwood Ln., Terrace Park, Ohio 45174

[21] Appl. No.: 08/305,865

[22] Filed: Sep. 14, 1994

[51] Int. Cl.[7] ..... A47K 11/12

[52] U.S. Cl. ..... 4/144.3; 4/144.1

[58] Field of Search ..... 4/144.1, 144.3

[56] References Cited

U.S. PATENT DOCUMENTS

| | | | |
|---|---|---|---|
| D. 245,267 | 8/1977 | Gruber | 4/144.1 X |
| D. 277,410 | 1/1985 | Floyd | D24/122 |
| D. 286,569 | 11/1986 | Nakao et al. | 4/144.1 X |
| D. 289,690 | 5/1987 | Hanson | D24/122 |
| 622,631 | 4/1899 | Orbeton | 4/144.3 |
| 901,134 | 10/1908 | Weidl | 4/144.3 X |
| 2,358,850 | 9/1944 | Chenault | 4/144.1 |
| 2,382,276 | 8/1945 | Wells | 4/144.1 |
| 2,542,276 | 2/1951 | Felts | 4/144.3 |
| 2,582,398 | 1/1952 | Siegenthal | D4/144.1 |
| 2,594,339 | 4/1952 | Nugent | 4/144.1 |
| 3,030,636 | 4/1962 | Evans | 4/144.3 |
| 3,473,172 | 10/1969 | Friedman et al. | 4/144.3 |
| 3,727,244 | 4/1973 | Collins | 4/144.3 |
| 3,900,019 | 8/1975 | Logiadis | 4/144.3 X |
| 4,050,103 | 9/1977 | Nakao et al. | 4/144.3 X |
| 4,194,508 | 3/1980 | Anderson | 4/144.3 X |
| 4,270,231 | 6/1981 | Zint | 4/144.1 |
| 4,270,539 | 6/1981 | Michaud | 4/144.3 X |
| 4,422,188 | 12/1983 | Strutton et al. | 4/144.1 X |
| 4,568,339 | 2/1986 | Steer | 4/144.3 X |
| 4,609,113 | 9/1986 | Seki | 215/382 |
| 4,665,571 | 5/1987 | Muccione | 4/144.1 |
| 4,681,572 | 7/1987 | Tokarz | 604/329 |
| 4,769,858 | 9/1988 | Gamm et al. | 4/144.3 |
| 5,387,205 | 2/1995 | Cummins | 4/144.3 X |

FOREIGN PATENT DOCUMENTS

| | | | |
|---|---|---|---|
| 349744 | 12/1960 | Switzerland | 4/144.1 |

*Primary Examiner*—Robert M. Fetsuga
*Attorney, Agent, or Firm*—Neal O. Willmann

[57] ABSTRACT

Urine collecting bottle is provided for use by a supine female, in which the bottle includes an opening portion with a mouth, and a liquid-collecting vessel attached to the opening portion through a neck portion. The liquid-collecting vessel is of a size and shape so as to rest on the same horizontal surface during use that the supine female is resting upon. The urine-collecting bottle includes a positioning handle and a carrying handle. The positioning handle includes two contoured recesses which can receive two fingers of a human hand, and are used by the supine person to position the urine-collecting bottle in the correct orientation for collecting urine while maintaining good hygiene. Each contoured recess has a forward surface and rearward surface that can contact one of the user's fingers thereby providing a fulcrum effect about the area around the mouth of the urine-collecting bottle. The user's fingers can be extended into the contoured recesses from either end of the contoured recesses. The mouth is inclined at an angle that allows the urine-collecting bottle to be placed upon the bed surface while the female user is in a supine position on that bed. The inclined angle of the mouth is designed to position the upper area of the mouth closer to the female than the lower area of the mouth. The mouth includes an annular bellows having a flexible inner lip, which provide a good sealing action against the vaginal area of the female user, and the inwardly-directing flexible lip also tends to retain liquid that has entered the mouth of the urine-collecting bottle.

2 Claims, 4 Drawing Sheets

FEMALE URINAL BOTTLE

TECHNICAL FIELD

The present invention relates generally to bottles usable as urinals and is particularly directed to urinal bottles of the type which can be used by a female human while reclined in a supine position. The invention is specifically disclosed as a urinal bottle which has an inclined opening that tilts toward the female's body and can be easily manipulated by the female's fingers so as to be properly positioned during use.

BACKGROUND OF THE INVENTION

Urine collecting bottles are well known in the art and have been in use for many years. Such bottles are often used to collect the urine of a bedridden patient who must attempt to urinate while lying in a supine position. It is particularly difficult for females to urinate in a supine position, especially while attempting to maintain good hygiene during the process of urination.

Most conventional urinal bottles have an open receptacle, or mouth, that is placed against the vagina of a human female and which leads to some type of liquid-tight container to collect and retain the urine until later disposal. Some conventional urinal bottles include a mouth that is inclined away from the female user, examples of which are disclosed in U.S. Pat. No. 2,594,339 (Nugent), U.S. Pat. No. 3,473,172 (Friedman et al.), U.S. Pat. No. Des. 286,569 (Nakao et al.), U.S. Pat. No. 4,665,571 (Muccione), and U.S. Pat. No. 4,769,858 (Gamm et al.). The use of such urinal bottles requires the supine female to sit up or rotate her hips to a certain extent so that the mouth of the urinal bottle provides a good seal around her vaginal area. For an immobilized female patient, such an inclined mouth is not easy to use while attempting to maintain good hygiene.

Another conventional urinal bottle, disclosed in U.S. Pat. No. 2,382,276 (Wells), provides an opening that is inclined in the opposite direction (i.e., toward the female user) but does not provide a substantially open area with which to collect urine, but instead provides a bladder with a stopper. A further conventional urinal bottle, disclosed in U.S. Pat. No. 3,432,866 (Schwartz), does not allow for ease of positioning with one hand of the patient or user, and is not designed to rest upon a horizontal surface during the urination process.

SUMMARY OF THE INVENTION

Accordingly, it is a primary object of the present invention to provide an improved urinal bottle that includes an opening or mouth that is inclined toward the female user for ease of use while that female user is resting in a supine position. This inclined mouth provides for a good seal around the vaginal area to minimize leakage during the urination process.

It is another object of the present invention to provide a urinal bottle that includes contoured recesses near the mouth of the urinal bottle such that the female user can use the fingers of one hand to properly position the urinal bottle around her vaginal area. The contoured recesses can be used to tilt the urinal bottle either forward or backward with ease, and they provide a fulcrum effect about the mouth of the urinal bottle for ease in such positioning.

It is a further object of the present invention to provide a urinal bottle which includes a positioning handle for use by a supine female user, and also provides a second carrying handle for use by a care-giver to assist an invalid patient that is unable to position the bottle by herself.

It is yet another object of the present invention to provide a urinal bottle that can be turned upside-down by 180° for use by a female in a squatting or sitting position.

It is yet a further object of the present invention to provide a urinal bottle that can be used by both male and female humans.

It is still another object of the present invention to provide a urinal bottle that can be placed on a horizontal surface along its bottom flat wall, and that can be stood up upon its rear end, at a 90° angle from its former position.

It is still a further object of the present invention to provide a urinal bottle that has a volume indicator on the surface of the bottle for measuring the volume of liquid within the bottle.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved urine-collecting bottle is provided of a size and shape to be used by a female human who is in a supine position during urination. The bottle includes an opening portion that has an oval mouth for collecting urine during the urination process. The opening portion is integrally connected to a liquid-collecting vessel portion through a neck portion, and the liquid-collecting vessel portion is of a size and shape so as to rest on the same horizontal surface that the supine female is resting upon. The urine-collecting bottle also includes a first, positioning handle attached to the rearward, upper surface of the opening portion (near the neck portion), and a second, carrying handle that is attached to the upper surface of the liquid-collecting vessel portion. The positioning handle includes two contoured surfaces or recesses which are of a size and shape to receive two fingers of a human's hand. These contoured recesses are used by the supine person to position the urine-collecting bottle in the correct orientation for collecting urine while maintaining good cleanliness and hygiene. Each contoured recess has a forward surface and rearward surface that, together, can contact both sides of one of the user's fingers so that the bottle can be pushed forward or backward, or tilted upward or downward, with only simple finger motions required by the user. The configuration of these contoured recesses is such that it provides a fulcrum effect about the area around the mouth of the urine-collecting bottle.

The mouth is inclined at an angle that allows the urine-collecting bottle to be placed upon the bed surface while the female user is in a supine position on that bed. The inclined angle of the mouth is designed to position the upper area of the mouth closer to the female than the lower area of the mouth. The mouth includes an annular bellows having a flexible inner lip. This bellows and inner lip provide a good sealing action against the vaginal area of the female user, and the inwardly-directing flexible lip also tends to retain liquid that has entered the mouth of the urine-collecting bottle. The carrying handle of the urine-collecting bottle can be used by a care giver who is using the urine-collecting bottle to allow an invalid to urinate without having to move from a resting supine position. The carrying handle can then be used to tilt the urine-collecting bottle upward so that the liquid inside remains in the collecting vessel portion of the bottle until the liquid can be disposed of. After the urine-collecting bottle is cleaned, the bottom portion of the positioning handle can be used to hang the urine-collecting bottle upon some type of horizontal rod or peg. The urine-collecting bottle can be positioned such that the bottom wall of its liquid-collecting vessel portion is resting upon a horizontal surface, or the bottle can be tilted up at a 90° angle so that its rear wall (at the end of the collecting vessel portion which is opposite the opening portion) is resting upon a horizontal surface. This tilted-up position can be used whether the urine-collecting bottle is empty or is containing liquid, and if liquid is present, its volume can be easily measured by use of a graduated scale in units of volume located upon one of the bottle's side surfaces. While urine collecting bottle is specifically designed for use with human females, it is also able to be used by human males. In addition, the urine-collecting bottle can be turned upside-down for use by a human female who is in a squatting or sitting position.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
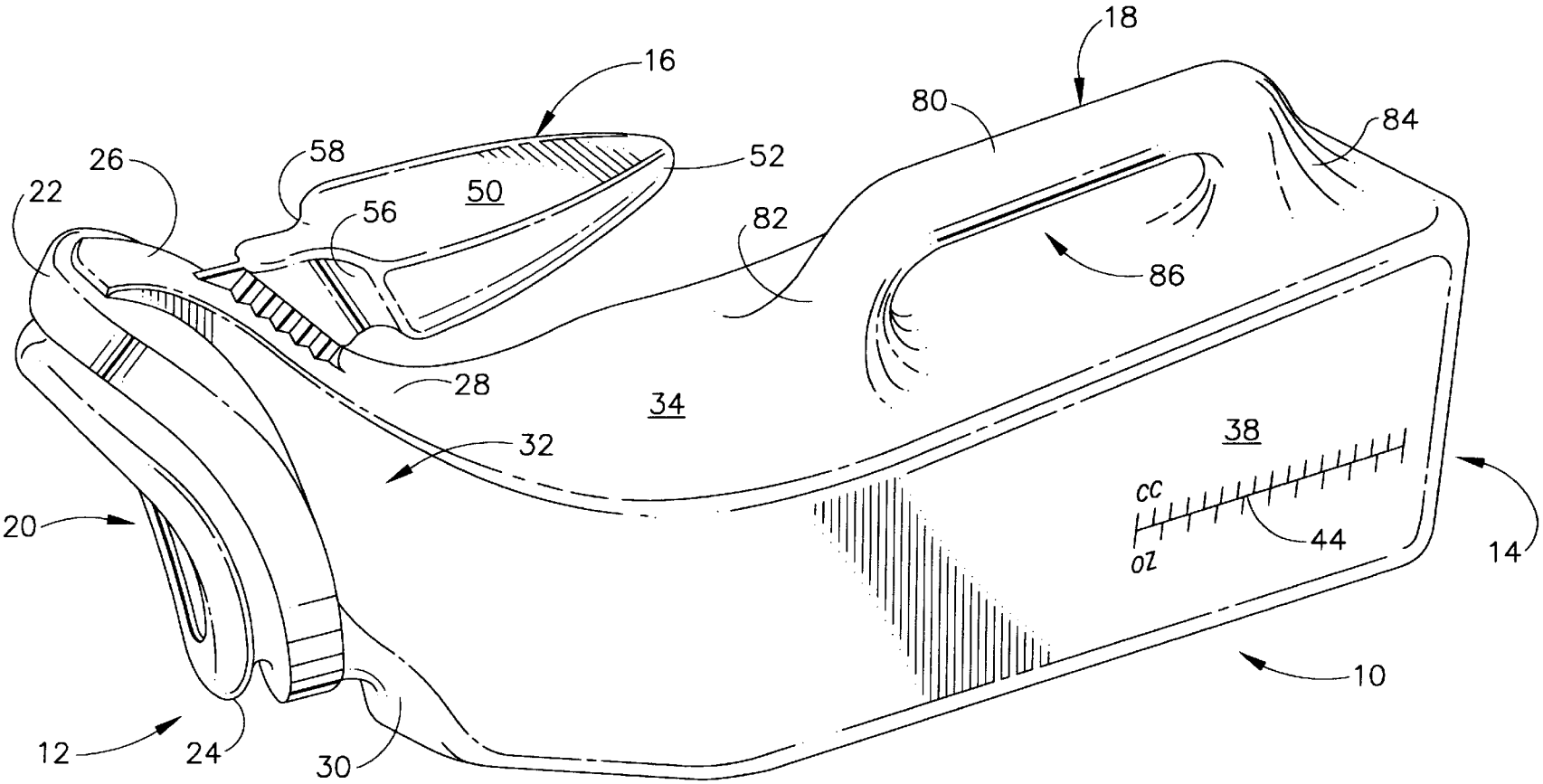
FIG. 1 is a perspective view of a bottle that can act as a female urinal and which is constructed according to the principles of the present invention.

Referring now to the drawings, FIG. 1 shows a urine-collecting bottle, generally designated by the index numeral 10, which is of a size and shape to be used by a female human who is in a supine position during use. Bottle 10 includes an opening portion 12 and a liquid-collecting portion or vessel 14, and has two handles, one used for positioning bottle 10 during use and for hanging bottle 10 during storage, generally depicted by the index numeral 16, and the other for carrying bottle 10 (a caretaker handle), generally indicated by the index numeral 18.

Figure 2:
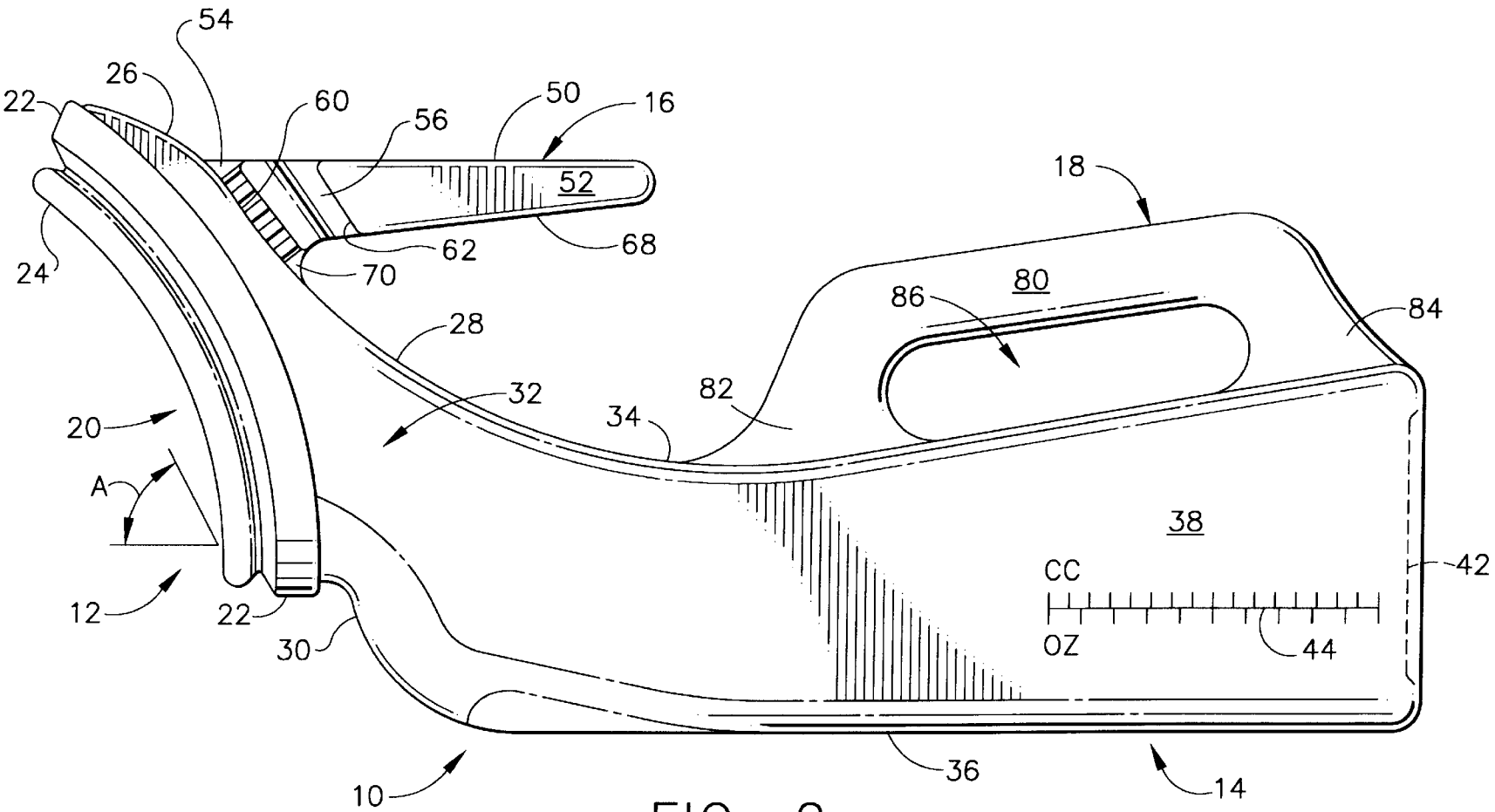
FIG. 2 is a side elevational view of the female urinal of FIG. 1.

The opening portion 12 includes an oval mouth 20 which is surrounded by a bellows 22. Mouth 20 and bellows 22 are configured to be placed against a female's vaginal area so as to catch the urine as the female is in the process of urination while in a supine position. As can be seen in FIG. 2, mouth 20 is inclined at an angle, generally designated by the letter "A," that allows bottle 10 to be placed upon a bed surface while the female user is in a supine position on that same bed. Angle "A" is preferably 60°, and is oriented such that the upper portion of mouth 20 is further from the collecting vessel 14 than is the lower portion of mouth 20. In addition, mouth 20 is preferably curved in a convex manner, as viewed from the side (see FIG. 2).

Bellows 22 has a flexible lip 24 which circumscribes mouth 20 about the inner diameter of bellows 22, and which extends inward toward the center of mouth 20. This flexible inner lip 24 helps to retain any urine that has entered through mouth 20 into the neck portion 32 and collecting vessel 14 of bottle 10. This feature will be described in greater detail hereinbelow. The other side of bellows 22 is attached to opening portion 12 of bottle 10, and includes an upper surface 26 near mouth 20 which is further connected to positioning handle 16. A rear wall 28, which is opposite mouth 20, slopes downward from upper surface 26 and continues toward the rear as a top wall 34 of collecting vessel 14. Neck portion 32 is bounded by rear wall 28 on its upper, rearward portion, and by a lower wall 30 on its lower, frontal portion, which is also connected to bellows 22 just below mouth 20. Lower wall 30 follows a relatively smooth curved profile (as seen in FIG. 2) and curves to form a horizontal bottom wall 36. In this manner, neck portion 32 provides a vertical offset by supporting opening portion 12 at a higher elevation than collecting vessel 14.

Figure 3:
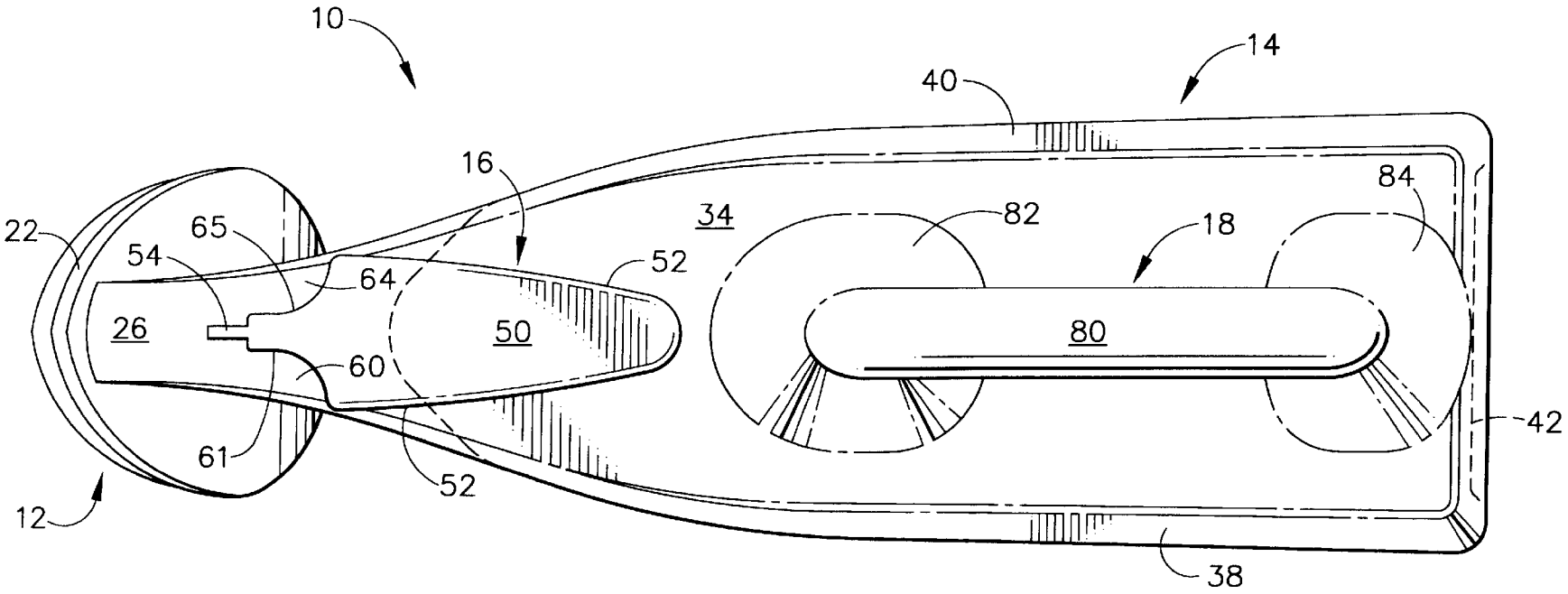
FIG. 3 is a top plan view of the female urinal of FIG. 1.

Collecting vessel 14 is formed by the top wall 34 and bottom wall 36, as well as two side walls 38 and 40, and a rear wall 42. Side walls 38 and 40 preferably slope somewhat outward from top wall 34 toward bottom wall 36, as seen in FIG. 3. Rear wall 42 is preferably somewhat recessed in its inner, central portions, so as to form a relatively square outer flat surface that can be used to stand bottle 10 up on its rear end (i.e., rear wall 42). The bottom wall 36 acts as a footprint for urine collecting bottle 10 as it rests in a horizontal position.

Urine collecting bottle 10 is designed so that, during use, a patient's urine will enter mouth 20 and either flow through neck portion 32 and into collecting vessel 14 directly, or flow against the rear wall 28 opposite mouth 20, which acts as a splash shield surface. Liquids striking rear wall 28 will tend to be deflected down through neck portion 32 and further into the collecting vessel 14, along the longitudinal axis of bottle 10. Once such liquids enter collecting vessel 14, they will tend to remain in collecting vessel 14 and not flow backwards through mouth 20, since the lower edge of mouth 20 is at an elevation above bottom wall 36 when urine collecting bottle 10 is in normal use. Any liquids that tend to back-flow through mouth 20 will have to first cross bellows 22, and also overcome the flexible lip 24 which surrounds the inner diameter of bellows 22. Since flexible inner lip 24 is directed toward the center portion of mouth 20, it will tend to catch and retain any liquids that are attempting to back-flow.

As related above, urine collecting bottle 10 can be rotated 90° and have its rear wall 42 placed against a horizontal surface. The preferred construction of bottle 10 is such that it will remain stable while sitting in such a position on a horizontal surface, whether or not it is holding any fluid in its collecting vessel 14. To rotate bottle 10 by 90° from its "horizontal position" (where it is resting on its bottom wall 36) to its "vertical" position (where it is resting on its rear wall 42), a person can easily put their fingers through a hand-hold gap 86 so as to grasp the shank 80 of carrying handle 18. Shank 18 is preferably rounded of such a size as to be easily grasped by a human hand, and hand-hold gap 86 is preferably large enough for the fingers and thumb of the human hand to easily slip through. The preferred construction of urine collecting bottle 10 is such that carrying handle 18 includes two mounting pedestals to connect shank 80 to top wall 34. The two mounting pedestals are forward pedestal 82 and rearward pedestal 84, as depicted in the figures.

Figure 4:
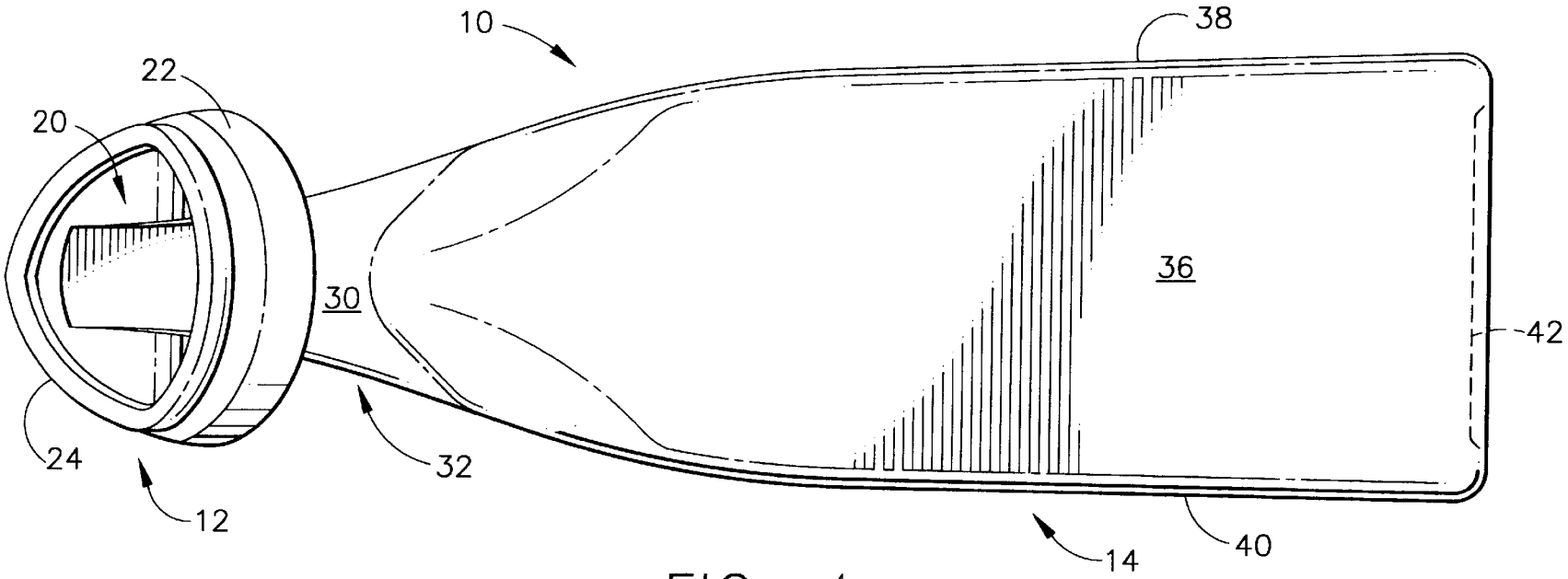
FIG. 4 is a bottom plan view of the female urinal of FIG. 1.

Positioning handle 16 includes a top surface 50, which has a generally spadelike shape when viewed from above (see FIG. 3), and which is bounded by a rounded side edge 52. Positioning handle 16 preferably is permanently attached to the rear upper wall of opening portion 12 via a flexible support, generally designated by the index numeral 54. Flexible support 54 is preferably constructed in a serpentine shape such that it will operate as a flexible accordion to allow the positioning handle 16 to be somewhat flexed in the horizontal plain (i.e., to the left or right as viewing mouth 20 from the left of FIG. 2), but will maintain greater rigidity to any attempted movement in the vertical plane. The portion of positioning handle 16 that is closest to flexible support 54 includes two contoured surfaces (or recesses), generally designated by the index numerals 56 and 58 (see FIG. 4). Contoured recesses 56 and 58 are of such a size and shape to provide a finger space for the user's hand to hold urine collecting bottle 10 by positioning the user's hand along the upper, rear wall 28 of opening portion 12.

In normal use, the user's hand will be positioned such that two fingers would fit around flexible support 54 such that each of those two fingers fit within contoured recess 56 or contoured recess 58. Within contoured recess 56, the user's finger would contact a forward surface 60, a side surface 61, and a rearward surface 62 (see FIG. 2). In a similar manner, within contoured recess 58, the user's finger would contact forward surface 64 (see FIG. 3), a side surface 65, and a rearward surface that is not shown in the figures. As can be seen in FIGS. 1 and 2, the rearward surface 62 of contoured recess 56 has a length that is more extensive than the vertical thickness of positioning handle 16, because the bottom surface 68 is curved downward as it approaches flexible support 54. This provides more surface area for finger contact along contoured recesses 56 and 58. Along most of its length, the bottom surface 68 of positioning handle 16 is parallel to top surface 50.

At the point where bottom surface 68 curves toward the flexible support 54, it is attached to a gusset 70 which is attached to the bottom portion of positioning handle 16. The overall shape of the curved surface of bottom surface 68 and gusset 70 is configured so as to make it easy to handle urine collecting bottle 10 and hang it on some type of peg or other substantially horizontal hanging device. Once placed upon such a hanging device, the contours of bottom surface 68, gusset 70, and rear wall 28 will tend to prevent urine collecting bottle 10 from falling off of the hanging device.

Contoured recess 56 and 58 make it easy for a user to hold urine collecting bottle 10 against her vaginal area while resting upon a bed in a supine position. If the user needs to press the bottom portion of mouth 20 any harder against her body, she can merely press her fingers more firmly against the forward surfaces 60 and 64. On the other hand, if the user wishes to increase the pressure of the upper portions of mouth 20 against her body, then she can pivot her fingers somewhat so as to press against the rearward surface 62 (and the associated rearward surface that it not shown in the figures) so as to tilt urine collecting bottle 10 so that its upper surface 26 is directed toward the vaginal area more closely. In effect, contoured recesses 56 and 58 allow the user to pivot urine collecting bottle 10 around a fulcrum that effectively exists near the upper portions of contoured recesses 56 and 58. Conventional urine collecting bottles have not provided such a fulcrum effect, and would require the user to use her second hand to bring the bottle upward so as to increase the pressure between the upper portion of the mouth and her vaginal area. The configuration of urine collecting bottle 10 of the present invention allows all of these movements to be accomplished with a single hand of the user (the one having its two fingers within contoured recesses 56 and 58).

In addition to the above, the user is provided with side surfaces 61 and 65 of contoured recesses 56 and 58, respectively. These side surfaces give stability in the transverse axis near mouth 20, so that positioning of bottle 10 is even easier to maintain by a single hand of the user.

It will be understood that contoured surfaces or recesses 56 and 58 could be made into various other configurations without departing from the principles of the present invention. For example, such recesses could each comprise an entire circle to make two loops through which the user's fingers could be placed, or the recesses could be merged into one large oval that could contain two fingers side-by-side, or even a hole for containing only one finger (at a loss of some stability in handling).

The configuration of positioning handle 16 and mouth 20 also allow urine collecting bottle 10 to be turned upside-down so that a female user can use bottle 10 in a squatting or a sitting position. This would allow a female user to have some type of urine collecting bottle for use in camping trips or other activities where permanent restrooms are not nearby. The female user would still place two of her fingers within contoured recesses 56 and 58 to hold urine collecting bottle 10 in place during such a use. Extra care would be required during this use to prevent spillage of the urine during use. A female user could even stand while using urine collecting bottle 10, if desirable. During such use, bottle 10 would likely be held in its upside-down position, but at a downward angle in the direction toward end wall 42. While holding urine collecting bottle 10 in an upside-down position, the female user would place two of her fingers through the opposite ends of contoured recesses 56 and 58, as compared to the ends of contoured recesses 56 and 58 entered during "normal" right-side-up usage. These contoured recesses 56 and 58 are preferably designed to allow easy manipulation of bottle 10 regardless of from which direction the user's fingers extend.

A female user may also use urine collecting bottle 10 while sitting on the edge of a bed. Bottle 10 would preferably be held in an upside-down position during urination under this circumstance. As related above, the female user would place two of her fingers within contoured recesses 56 and 58 to maneuver bottle 10 for proper orientation while collecting her urine.

It will be understood that urine collecting bottle 10 may easily be used with a male human rather than a female. Bottle 10 could be used in either its "normal" right-side-up position, or its upside-down position. The upside-down position of bottle 10 is preferable in this circumstance.

Carrying handle 18 can also be used by a "care giver" who is attempting to assist an invalid who needs to urinate. By holding carrying handle 18, the care giver can place urine collecting bottle 10 between the legs of the invalid and gently press the mouth 20 against the vaginal area of the invalid in a position such that bottle 10 will properly catch the urine in a sanitary manner. After the urination has been accomplished, carrying handle 18 is further used to tilt urine collecting bottle 10, thereby retaining the urine in collecting vessel 14.

When emptying urine collecting bottle 10, the user or the care giver merely tilts urine collecting bottle 10 forward until the urine pours out of collecting vessel 14, through neck portion 32, and through opening portion 12 out mouth 20. Lower surface 30 is shaped so as to easily drain all of the urine out of the collecting vessel 14 without forming any air pockets or other obstructions that may tend to prevent all of the urine from being drained out. Bellows 22 are also shaped to assist a majority of the urine from easily leaving the inner portions of urine collecting bottle 10. Flexible inner lip 24 may tend to catch some of this urine, however mouth 20 is preferably large enough that any urine that has been caught in bellows 22 or flexible inner lip 24 can be wiped off with some type of towel or napkin. After such a use, urine collecting bottle 10 can be easily cleaned and then placed upon some type of peg or other rack as described hereinabove.

Urine collecting bottle 10 is preferably made of some type of clear plastic material such as low density polyethylene. It is preferred that urine collecting bottle 10 be made in a blow-molding process in which the main body portion, including opening portion 12, collecting vessel 14, and neck portion 32, is formed through a space that becomes mouth 20, and positioning handle 16 is formed through a small needle hole in top surface 50. Since flexible support 54 is not hollow, the blow molding process will have to be performed in two cavities simultaneously with air introduced into the needle hold in top surface 50 and through what will become the mouth 20. It will be understood that other methods of manufacturing urine collecting bottle 10 can be accomplished without departing from the principles of the present invention.

Graduated markings 44 are preferably placed upon side wall 38 of urine collecting bottle 10. These markings 44 are graduated for units of volume, such as cubic centimeters ("cc") or for fluid ounces ("oz"). Since urine collecting bottle 10 can stand up upon its rear wall 42, the urine level will become parallel to rear wall 42, thereby providing a ready reference to compare to graduated markings 44. This is another reason to manufacture bottle 10 of a relatively transparent material.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A urinal bottle for use by a single human hand, comprising:

a collecting vessel having a top wall, bottom wall, two side walls and a rear wall, said collecting vessel walls being liquid-tight;

an opening portion having a substantially oval mouth with an upper portion and a lower portion, said mouth being inclined at an angle so that the upper portion of the mouth is farther from the collecting vessel than the lower portion of the month;

a neck portion extending between said opening portion and said collecting vessel and offsetting said mouth above the bottom wall of said collecting vessel, said neck portion being liquid-tight; and positioning means flexibly attached to the rear wall of the opening portion having at least two contoured surfaces for accepting the rearward finger surfaces of a human hand.

2. The urinal bottle of claim 1 wherein the positioning means further defines a handle.

* * * * *